US006474942B2

(12) United States Patent
Markytan

(10) Patent No.: US 6,474,942 B2
(45) **Date of Patent: *Nov. 5, 2002**

(54) AIRFOIL CONFIGURED FOR MOISTURE REMOVAL FROM STEAM TURBINE FLOW PATH

(75) Inventor: Rudolf M. Markytan, Niskayuna, NY (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/476,101

(22) Filed: Jan. 3, 2000

(65) Prior Publication Data

US 2002/0114700 A1 Aug. 22, 2002

(51) Int. Cl.[7] ..... F01D 25/32

(52) U.S. Cl. ..... 415/169.2; 415/169.3; 416/228; 416/231 B; 416/236 R

(58) Field of Search ..... 415/169.2, 169.3, 415/169.4; 416/224, 228, 231 B, 236 R, 236 A

(56) References Cited

U.S. PATENT DOCUMENTS

| | | | | |
|---|---|---|---|---|
| 465,439 A | * | 12/1891 | Vinal | 416/224 |
| 741,776 A | * | 10/1903 | Dodge | 415/169.2 |
| 3,304,056 A | * | 2/1967 | Sohma | 416/236 |
| 4,957,410 A | * | 9/1990 | Silvestri, Jr. | 415/169.1 |
| 5,261,785 A | | 11/1993 | Williams | |

FOREIGN PATENT DOCUMENTS

| | | | | |
|---|---|---|---|---|
| JP | 54-44112 | * | 4/1979 | 415/169.3 |
| JP | 58-176404 | * | 10/1983 | 415/169.3 |
| JP | 1-45904 | * | 2/1989 | 415/169.3 |
| JP | 1-110812 | * | 4/1989 | 415/169.3 |
| SU | 525805 | * | 8/1976 | 415/169.3 |
| SU | 737636 | * | 5/1980 | 415/169.4 |

* cited by examiner

*Primary Examiner*—Christopher Verdier
(74) *Attorney, Agent, or Firm*—Nixon & Vanderhye PC

(57) ABSTRACT

To remove moisture from the steam flow path of steam turbines, one or more grooves are located on the pressure or concave side of the steam turbine stationary and/or rotating airfoils. The grooves are oriented predominantly radially and are disposed close to the airfoil trailing or exit edge. Moisture deposited on the surface of the airfoil flows into the groove and, due to pressure and/or centrifugal forces, the moisture flows to the turbine inner or outer sidewall and, thus, is available for removal from the steam path in the same blade row in which it was first deposited. An advantage of removing moisture in the blade row in which it was first deposited is that it reduces efficiency losses associated with the chronology of the moisture downstream of the airfoil trailing edge.

17 Claims, 3 Drawing Sheets

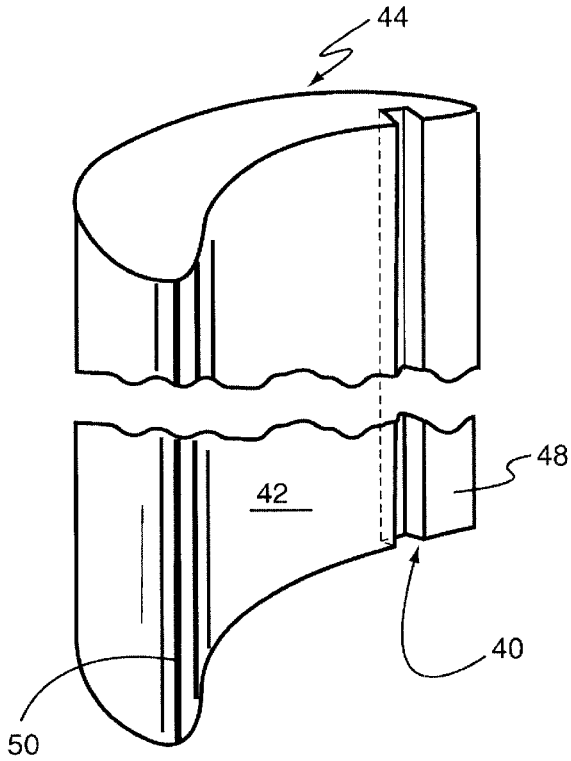
Fig.7
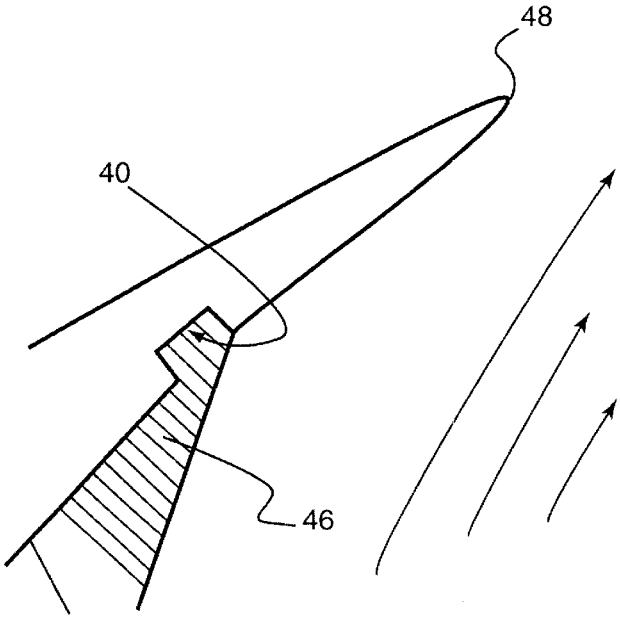
42 Fig.8
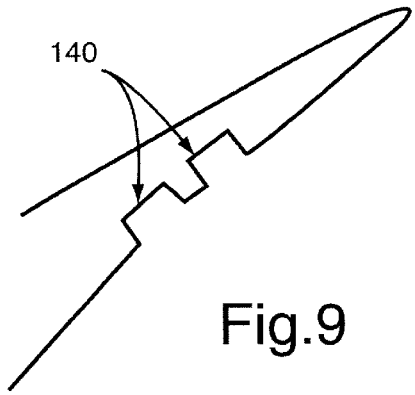
Fig.9

AIRFOIL CONFIGURED FOR MOISTURE REMOVAL FROM STEAM TURBINE FLOW PATH

BACKGROUND OF THE INVENTION

The present invention relates to steam turbines and, in particular, to airfoils configured for removing moisture from the steam flow path of a steam turbine.

In the case of wet steam, both steam-borne, or primary, moisture and moisture deposited on the internal metal surfaces of the steam path, i.e. secondary moisture, cause efficiency losses and the potential for erosion. The path of deposited moisture in a steam turbine stage may be tracked as follows. In the context of a steam turbine, a "stage" is comprised of and defined as two rows of airfoils; one stationary and the other rotating with the rotating row of airfoils disposed downstream of the stationary row of airfoils. The moisture starts out as either primary moisture or secondary moisture that is carried over from the previous stage or stages of the turbine. With reference to FIGS. 1 and 4, the moisture, shown generally at 10 in FIG. 4, is deposited on the pressure or concave side 12 of the stationary airfoil 14. The moisture is driven by the steam to the stationary airfoil trailing edge 16 as shown in FIGS. 4 and 5. The moisture is torn off from there in the form of clusters of water which move in the same direction as, but slower than the steam, in the wake behind the stationary airfoils 14. The moisture is then atomized as the relative velocity between it and the surrounding steam reaches a certain threshold. At this point, the moisture is significantly increased in its rate of acceleration while still moving slower than the surrounding steam.

Referring to FIG. 2, a velocity vector diagram in the nozzle-bucket space is shown. In this figure, W is the bucket rotational speed, $V_W$ is the absolute water velocity, $V_S$ is the absolute steam velocity, $V_{SB}$ is the steam velocity relative to the bucket, and $V_{WB}$ is the water velocity relative to the bucket. Thus the moisture, shown generally at 18, at a high relative velocity $V_{WB}$ impacts the rotating airfoil leading edge 22, as shown in FIG. 1. Referring to FIG. 3, conventionally a number of (typically three) radial grooves 24 are located on the rotating airfoil 20 suction or convex side 26, close to the airfoil leading edge 22 for removing the moisture 18 impacted thereon. The disadvantage of these grooves 24 is that they only remove moisture that has already caused significant efficiency losses. Indeed, efficiency losses of various kinds are realized from when the moisture 10 is first deposited on the stationary airfoil pressure side 12 up to and including moisture 18 interception by the rotating leading edge 22.

FIG. 6 is a view similar to FIG. 5, showing the moisture, generally at 28, that is deposited on the pressure or concave side 30 of the rotating airfoil 20. The moisture is driven by the steam to the rotating airfoil trailing or exit edge 32 and, at the same time, by centrifugal force to the bucket tip 33. From there, part of the secondary moisture is removed from the steam flow path, while the remainder is carried over to the next stage, with the potential for further efficiency losses and erosion.

BRIEF SUMMARY OF THE INVENTION

To remove moisture from the steam flow path in a steam turbine, a single groove or a plurality of grooves are located on the pressure or concave side of nuclear and fossil steam turbine stationary and rotating airfoils operating in a wet steam environment. In the presently preferred embodiment, these grooves are oriented predominantly radially and are located closer to the airfoil trailing or exit edge than the leading or inlet edge. These grooves raise the effectiveness by which secondary moisture is removed from the steam path and eliminate or reduce the efficiency losses associated with this moisture.

Accordingly, the invention is embodied in an airfoil for removing moisture from the flow path of a steam turbine wherein the airfoil has first and second longitudinal ends and an outer peripheral wall extending therebetween. The outer peripheral wall defines an airfoil leading edge, an airfoil trailing edge, a generally concave side face and a generally convex side face. At least one groove is defined in the concave side face so as to extend in a direction generally corresponding to a longitudinal extent of the outer peripheral wall along at least a portion of a length of the outer peripheral wall.

The invention is also embodied in a steam turbine having at least one row of stationary airfoils and at least one row of rotating airfoils disposed downstream from said stationary airfoils, wherein the airfoils of at least one of those rows are moisture removing airfoils, each moisture removing airfoil having first and second longitudinal ends and an outer peripheral wall extending therebetween, the outer peripheral wall defining an airfoil leading edge, an airfoil trailing edge, a generally concave side face and a generally convex side face, and wherein at least one groove is defined in the concave side face, the groove extending along at least a portion of a length of the outer peripheral wall.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which:

FIG. 7 is a schematic perspective view showing an airfoil having a moisture catching groove as an exemplary embodiment of the invention;

FIG. 8 is an enlarged schematic cross-sectional view of an airfoil trailing edge portion embodying the invention; and FIG. 9 is a schematic cross-sectional view of an airfoil trailing edge portion according to an alternate embodiment of the invention.

DETAILED DESCRIPTION OF THE INVENTION

Figure 1:
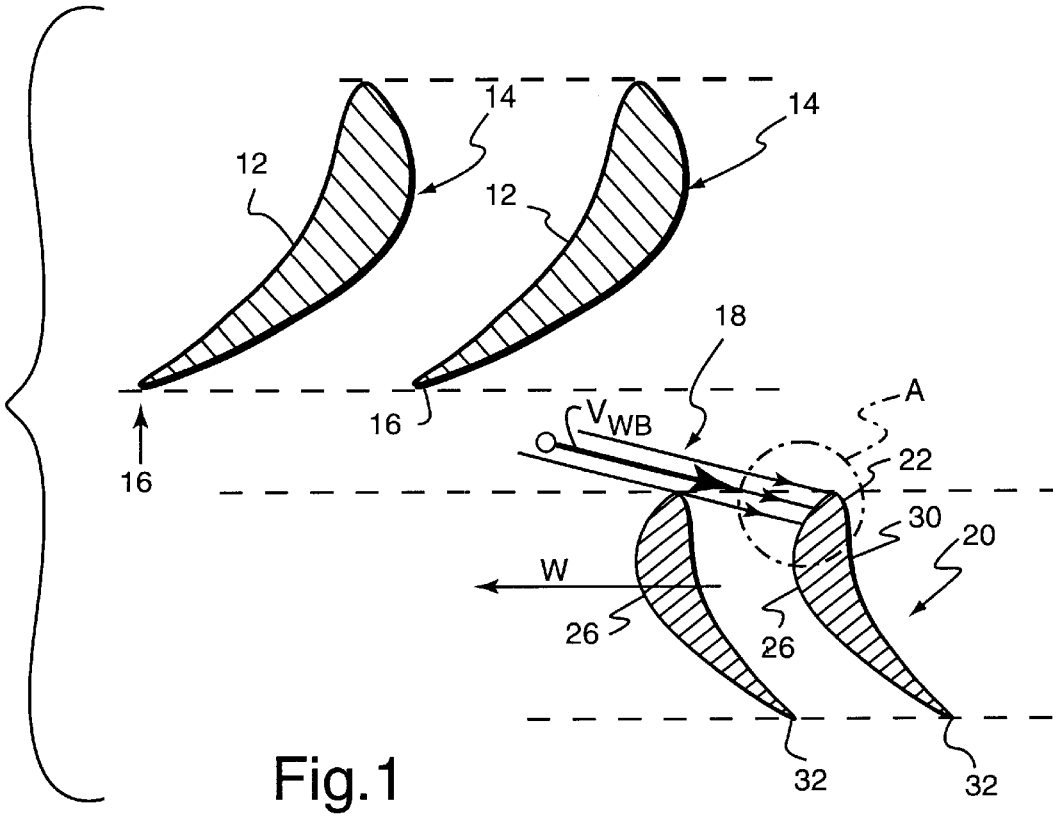
FIG. 1 is a schematic cross-sectional view of a portion of a turbine stage showing steam and moisture flow therethrough.
Figure 3:
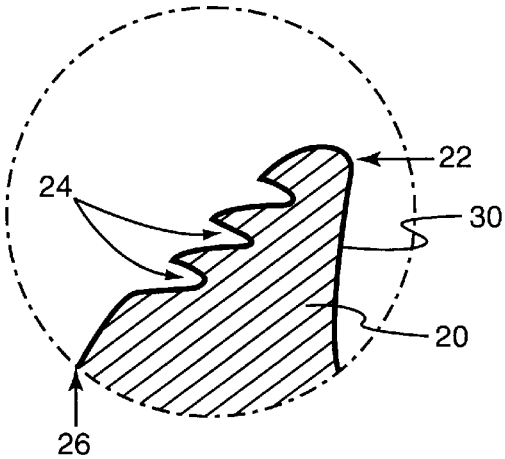
Fig.3 (PRIOR ART)
FIG. 3 is an enlarged schematic cross-sectional view corresponding to detail A in FIG. 1.
Figure 2:
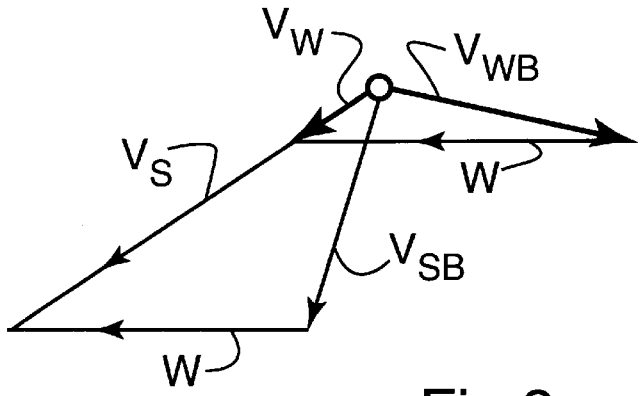
FIG. 2 is a velocity vector diagram in the nozzle-bucket space.
Figure 4:
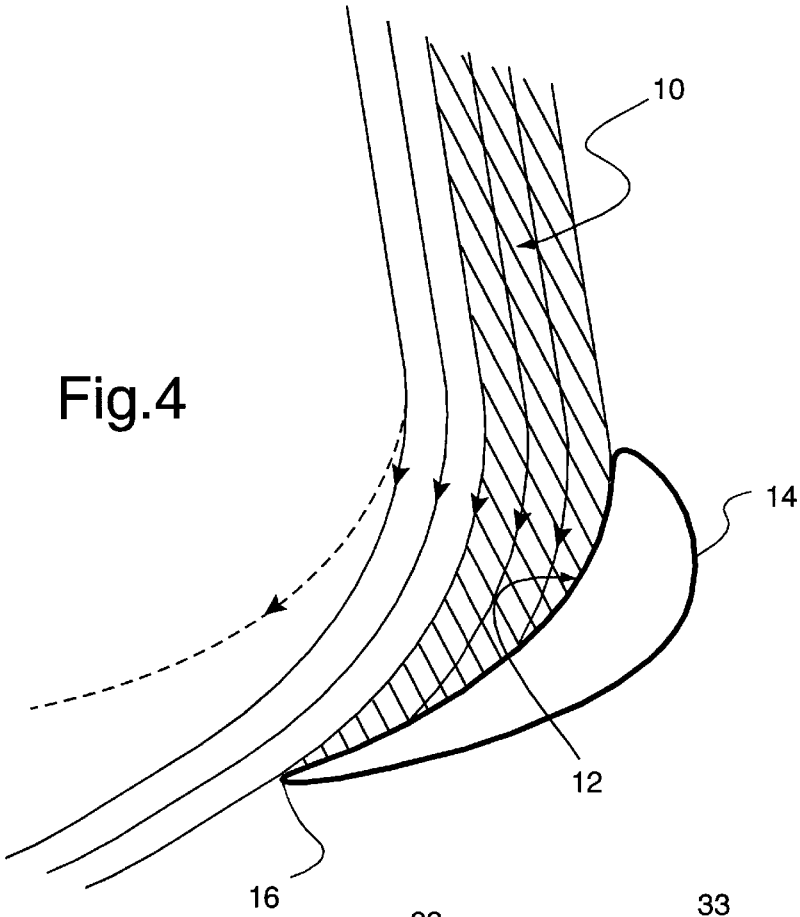
FIG. 4 is a schematic cross-sectional view from above showing droplet travel just before deposition on a stationary airfoil pressure side.
Figure 5:
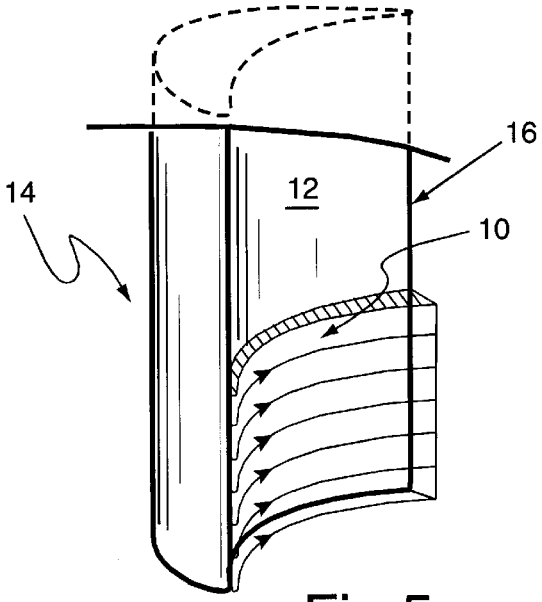
FIG. 5 is a perspective view from upstream showing water film driven by drag forces on a stationary airfoil pressure side.
Figure 6:
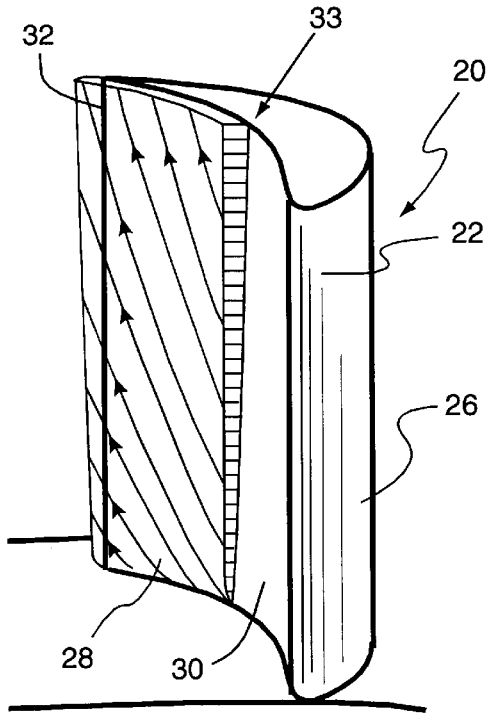
FIG. 6 is a schematic perspective view from upstream showing water film driven by drag and centrifugal forces on a bucket concave side.

The invention is embodied in an improved airfoil for operating in a wet steam environment and, in particular, an airfoil which has a single groove or a plurality of grooves located on the pressure or concave side thereof. The groove (s) may be adapted to steam turbine stationary and/or rotating airfoils. Thus, as illustrated by way of example in FIG. 7, at least one moisture capturing groove 40 is located on the pressure or concave side 42 of the airfoil 44 so as to extend generally radially, in the longitudinal direction of the airfoil 44. The groove 40 is designed to raise the effectiveness by which primary moisture, generally designated 46 in FIG. 8 and turned into secondary moisture upon its deposition on the airfoil pressure side 42, is removed from the steam path so as to eliminate or reduce the efficiency losses associated with this moisture. If, for whatever reason, removal of this moisture is not possible, a secondary mechanism of reducing the efficiency losses associated with this moisture is to move it radially to a location where its negative impact on efficiency and/or erosion is smaller. More particularly, as discussed above with reference to FIGS. 1, 4, 5 and 6, moisture that starts out as either primary moisture or secondary moisture carried over from the previous stage or stages will be deposited on the airfoil 44 pressure side 42 and will be driven by the steam towards the airfoil trailing edge 48. In that regard, FIGS. 5 and 6 provide general pictorial explanations of how deposited moisture moves on the surface of stationary and rotating airfoils, respectively. From these illustrations it will be appreciated that the moisture 46 deposited on airfoil 44 will be driven to and can be collected in the groove(s) 40 before it can complete its movement to the airfoil trailing edge 48.

Once inside the groove(s) 40, the moisture 46, supported by pressure and/or centrifugal forces, flows to the steam path inner or outer side wall and, there, becomes available for removal from the steam path in the very same stationary or rotating blade row in which it was first deposited. As can be appreciated, the net effect of capturing and removing moisture via groove(s) 40 is a reduction in the efficiency losses associated with this moisture. Indeed, because the moisture 46 is driven to and collects in the groove(s) 40 before its movement to the airfoil trailing edge 48 can be completed, efficiency losses associated with moisture being torn off from the airfoil trailing edge as water clusters, movement in the wake behind the stationary airfoils, atomization and acceleration of the moisture, and impact on downstream rotating airfoils are eliminated with respect to moisture collected in the grooves.

In the embodiment illustrated in FIG. 7, a single groove, trench or rut 40 is illustrated by way of example. It is to be understood, however, that instead, a small number of narrow or shallow grooves 140 (FIG. 9) or a large number of very narrow and/or shallow grooves, which may be referred to as "micro-grooves", can be provided. The groove 40 is oriented in a generally radial direction, generally longitudinally of the airfoil 44, closer to the airfoil trailing edge 48 than the leading edge 50. Generally radially as used herein means that the groove extends generally in a direction that is more radial than axial, with the object of channeling the moisture radially out of the steam path. Thus groove or grooves, in particular those provided on stationary airfoils may be inclined to radial so as encourage moisture flow therealong radially outwardly and/or radially inwardly as desired. As illustrated in FIGS. 7, 8 and 9, the outer peripheral wall of the airfoil is comprised of a leading portion extending from the leading edge at least to a transverse midpoint of the airfoil, which has a smooth, continuously curved surface, and a trailing portion in the vicinity of the trailing edge. The at least one groove 40,140 embodying the invention is provided in the trailing edge portion of the outer peripheral wall.

In the illustrated embodiment, a groove 40 is illustrated that has a generally rectangular cross-section, having planar walls. It is to be understood, however, that the invention is not limited to a particular depth and/or cross-sectional shape of the groove(s) 40, provided the groove depth and shape is effective to receive and facilitate the removal of deposited moisture. Thus, the cross-sectional shape may be varied so as to be curved in part, continuously curved, V-shaped, symmetric or non-symmetric in cross-section. Moreover, where plural grooves are provided those grooves may be, but are not necessarily disposed in parallel (See FIG. 9). Further, as noted above, it is to be understood that the groove(s) are not necessarily limited to straight grooves and the grooves may be made up of segments of differing longitudinal shape, i.e. straight or curved, or inclination/direction. Thus, for example, the groove(s) may be comprised of segments oriented in one direction along a portion of the length of the airfoil and oriented in another direction along another portion of the length of the airfoil so that a portion of the moisture will be directed radially outwardly and another portion directed radially inwardly, depending upon the point along the length of the airfoil at which it is intercepted by the groove. Additionally the grooves may be of constant depth along the span of the airfoil or may vary from a greater depth at one point to a lesser depth at another point. Moreover, one or more grooves may be provided that start and/or end abruptly or gradually anywhere along the span of the airfoil, to maximize interception and removal of moisture. Thus, if moisture deposition is concentrated in a particular radial region, it may be desirable to increase groove density in that area.

As is apparent from the foregoing, the pressure side groove(s) as described hereinabove may be advantageously provided on stationary and rotating airfoils, in nuclear and fossil steam turbines.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An airfoil disposed in a row of rotating airfoils in a steam turbine for removing moisture from a flow path of the steam turbine wherein said airfoil has first and second longitudinal ends and an outer peripheral wall extending therebetween, said outer peripheral wall defining an airfoil leading edge, an airfoil trailing edge, a generally concave side face and a generally convex side face, a leading portion of said concave side face, from said airfoil leading edge at least to a transverse midpoint thereof, having a smooth, continuously curved surface, and wherein at least two open grooves are defined in a trailing portion of said concave side face, adjacent said airfoil trailing edge, each said groove being non-penetrating to any cavity or compartment of the airfoil, each of said at least two grooves being oriented so that a longitudinal axis thereof extends along at least a portion of a longitudinal length of said outer peripheral wall.

2. An airfoil as in claim 1, wherein said at least two parallel grooves each extend in a direction generally corresponding to a longitudinal extent of said outer peripheral wall.

3. An airfoil as in claim 1, wherein said at least two grooves extend substantially an entire length of said outer peripheral wall.

4. An airfoil as in claim 1, wherein at least one of said at least two grooves has generally planar side walls.

5. An airfoil as in claim 4, wherein said at least one of said at least two grooves is generally rectangular in cross-section.

6. A steam turbine having at least one row of stationary airfoils and at least one row of rotating airfoils disposed downstream from said stationary airfoils, wherein the airfoils of said row of rotating airfoils are moisture removing airfoils, each said moisture removing airfoil having first and second longitudinal ends and an outer peripheral wall extending therebetween, said outer peripheral wall defining an airfoil leading edge, an airfoil trailing edge, a generally concave side face and a generally convex side face, and wherein at least one open groove is defined in said concave side face, said at least one groove extending along at least a portion of a length of said outer peripheral wall, each said groove being non-penetrating to any cavity or compartment of the airfoil.

7. A steam turbine as in claim 6, wherein said at least one groove extends in a direction generally corresponding to a longitudinal extent of said outer peripheral wall.

8. A steam turbine as in claim 6, wherein said at least one groove extends substantially an entire length of said outer peripheral wall.

9. A steam turbine as in claim 6, wherein said outer peripheral wall defines a trailing portion in a vicinity of said trailing edge and a leading portion in a vicinity of said leading edge, and wherein said at least one groove is disposed in said trailing portion of said outer peripheral wall.

10. A steam turbine in claim 6, wherein said at least one groove has generally planar side walls.

11. A steam turbine as in claim 6, wherein said at least one groove is generally rectangular in cross-section.

12. A steam turbine as in claim 6, wherein the concave face includes a leading portion extending from said airfoil leading edge to at least a transverse midpoint thereof that has a smooth, continuously curved surface and a trailing edge portion adjacent said airfoil trailing edge, said at least one groove being defined in said trailing portion of said concave side face.

13. A steam turbine as in claim 6, wherein there are at least two grooves, each extending along at least a portion of a length of said outer peripheral wall.

14. A steam turbine as in claim 13, wherein said at least two grooves are disposed in parallel.

15. A steam turbine as in claim 14, wherein said at least two grooves are disposed in parallel to said trailing edge.

16. A steam turbine having at least one row of stationary airfoils and at least one row of rotating airfoils disposed downstream from said stationary airfoils, wherein at least one of the airfoils of said at least one row of rotating airfoils is a moisture removing airfoil, each said moisture removing airfoil having first and second longitudinal ends and an outer peripheral wall extending therebetween, said outer peripheral wall defining an airfoil leading edge, an airfoil trailing edge, a generally concave side face and a generally convex side face, and wherein at least two open grooves are defined in said concave side face, each said groove being non-penetrating to any cavity or compartment of the airfoil, and each of said at least two grooves being oriented so that a longitudinal axis thereof extends along at least a portion of a longitudinal length of said outer peripheral wall.

17. A steam turbine as in claim 16, wherein said outer peripheral wall includes a leading portion in a vicinity of said leading edge and a trailing portion in the vicinity of said trailing edge, said at least two grooves being defined in said trailing portion and said leading portion comprising a smooth, continuously curved surface.

* * * * *